US007686663B1

(12) United States Patent
Zapolsky

(10) Patent No.: US 7,686,663 B1
(45) Date of Patent: Mar. 30, 2010

(54) CONNECTOR FOR AN AUDIO CABLE, A COMBINATION CONNECTOR AND CABLE, AND A METHOD OF SECURING SAID CONNECTOR TO SAID CABLE

(76) Inventor: Benjamin Zapolsky, 1449 Knapp St., Oshkosh, WI (US) 54902

( * ) Notice: Subject to any disclaimer, the term of this patent is extended or adjusted under 35 U.S.C. 154(b) by 0 days.

(21) Appl. No.: 12/317,841

(22) Filed: Dec. 30, 2008

(51) Int. Cl.
*H01R 4/10* (2006.01)

(52) U.S. Cl. ..... 439/879; 439/888

(58) Field of Classification Search ..... 439/879, 439/888, 883; 174/89
See application file for complete search history.

(56) References Cited

U.S. PATENT DOCUMENTS

| | | | | |
|---|---|---|---|---|
| 2,396,872 | A | 3/1946 | Miller et al. | |
| 2,576,227 | A | 11/1951 | Hutchins, Jr. | |
| 2,681,441 | A | 6/1954 | Linn | |
| 3,210,719 | A | 10/1965 | Graeff | |
| 3,980,380 | A | 9/1976 | Cieniawa et al. | |
| 4,281,887 | A | 8/1981 | Luca, Jr. | |
| 4,734,544 | A | 3/1988 | Lee | |
| 4,910,360 | A | 3/1990 | Lee | |
| 4,937,401 | A | 6/1990 | Lee | |
| 4,997,992 | A | 3/1991 | Low | |
| 5,108,320 | A * | 4/1992 | Kimber | 439/883 |
| 5,376,758 | A | 12/1994 | Kimber | |
| 5,519,173 | A | 5/1996 | Newmoyer et al. | |
| 5,850,692 | A * | 12/1998 | Schock et al. | 439/942 |
| 5,939,679 | A | 8/1999 | Olsson | |
| 6,476,328 | B2 | 11/2002 | Agostinelli | |
| 6,997,746 | B2 * | 2/2006 | Taylor | 439/585 |
| 7,086,897 | B2 | 8/2006 | Montena | |
| 7,174,633 | B2 * | 2/2007 | Onuma | 439/877 |
| 7,299,549 | B2 * | 11/2007 | Montena | 439/578 |
| 2008/0053682 | A1 | 3/2008 | Victor | |

* cited by examiner

*Primary Examiner*—Briggitte R Hammond
(74) *Attorney, Agent, or Firm*—Thomas J. Connelly; Wilhelm Law. S.C.

(57) ABSTRACT

A connector for an audio cable, a combination connector and cable, and a method of securing the connector to the cable are disclosed. The connector includes a connector body formed from an electrically conductive material and having a first end sized to abut an end of an audio speaker cable, a second end shaped to be securely attached to a connecting post formed on a piece of audio equipment, and an exterior surface located therebetween. The exterior surface has a first portion, a second portion and a third portion. The first portion is sized to receive the exposed terminal surface of each of a plurality of wires present in the cable. An insulating layer extends over the exposed terminal surface of each of said wires and a band surrounds the insulating layer to provide a positive electrical interface between the exposed terminal surfaces and the first portion.

20 Claims, 3 Drawing Sheets

METHOD OF SECURING A CONNECTOR TO AN AUDIO CABLE, COMPRISING THE STEPS OF:

FORMING A CONNECTOR BODY FROM AN ELECTRICALLY CONDUCTIVE MATERIAL, SAID CONNECTOR BODY HAVING A LONGITUDINAL CENTRAL AXIS, A FIRST END SIZED TO ABUT AN END OF AN AUDIO CABLE, A SECOND END SHAPED TO BE SECURELY ATTACHED TO A CONNECTING POST FORMED ON A PIECE OF AUDIO EQUIPMENT, AND AN EXTERIOR SURFACE WHICH EXTENDS BETWEEN SAID FIRST AND SECOND ENDS, SAID EXTERIOR SURFACE HAVING A FIRST PORTION, A SECOND PORTION AND A THIRD PORTION, SAID FIRST PORTION HAVING A CIRCULAR OUTER PERIPHERY WITH A LENGTH MEASURED PARALLEL TO SAID LONGITUDINAL CENTRAL AXIS, SAID FIRST PORTION BEING LOCATED ADJACENT TO SAID FIRST END AND HAVING A PLURALITY OF CAVITIES FORMED THEREIN EACH BEING SIZED TO RECEIVE AN EXPOSED TERMINAL SURFACE OF A WIRE, SAID SECOND PORTION BEING RELATIVELY FLAT AND LOCATED ADJACENT TO SAID SECOND END, AND SAID THIRD PORTION CONVERGES DOWNWARD FROM SAID FIRST PORTION TO SAID SECOND PORTION;

FORMING AN AUDIO CABLE HAVING A FLEXIBLE TUBULAR CORE FORMED FROM A NON-ELECTRICALLY CONDUCTIVE MATERIAL, SAID CORE HAVING A LONGITUDINAL CENTRAL AXIS, A FIRST END, AND A CIRCUMFERENTIAL SURFACE SPACED AT A CONSTANT RADIUS FROM SAID LONGITUDINAL CENTRAL AXIS, A PLURALITY OF SPACED APART METALLIC WIRES EXTENDING ALONG AND POSITIONED OUTWARD OF SAID CIRCUMFERENTIAL SURFACE, EACH OF SAID WIRES HAVING AN EXPOSED TERMINAL SURFACE WHICH EXTENDS BEYOND SAID FIRST END OF SAID TUBULAR CORE, EACH OF SAID WIRES BEING POSITIONED AT AN EQUAL DISTANCE FROM SAID LONGITUDINAL CENTRAL AXIS, AND A COVER LAYER SURROUNDING AT LEAST A PORTION OF SAID TUBULAR CORE AND SAID PLURALITY OF WIRES;

ABUTTING SAID FIRST END OF SAID CONNECTOR AGAINST SAID FIRST END OF SAID CABLE SUCH THAT SAID EXPOSED TERMINAL SURFACE OF EACH OF SAID WIRES WILL BE POSITIONED IN ONE OF SAID CAVITIES;

POSITIONING AN INSULATING LAYER OVER AT LEAST THE LENGTH OF SAID FIRST PORTION SUCH THAT IT SURROUNDS SAID EXPOSED TERMINAL SURFACE OF EACH OF SAID WIRES:

POSITIONING A PLIABLE BAND ABOUT SAID INSULATING LAYER SUCH THAT IT EXTENDS OVER SAID FIRST PORTION; AND

CRIMPING SAID PLIABLE BAND TO PROVIDE A POSITIVE ELECTRICAL INTERFACE BETWEEN SAID EXPOSED TERMINAL SURFACE OF EACH OF SAID WIRES AND SAID FIRST PORTION.

FIG. 12

CONNECTOR FOR AN AUDIO CABLE, A COMBINATION CONNECTOR AND CABLE, AND A METHOD OF SECURING SAID CONNECTOR TO SAID CABLE

FIELD OF THE INVENTION

This invention relates to a connector for an audio cable, a combination connector and cable and a method of securing said connector to said cable.

BACKGROUND OF THE INVENTION

Today, many different kinds of audio equipment, audio cables and connectors are utilized for various applications. In most of these situations, the user is seeking to transmit high quality sounds. Along with improved sound quality, many users would also like to minimize distortion in audio cables, minimize phase distortion and eliminate skin effect. Skin effect causes electricity to be concentrated at the surface of a wire with decreasing concentration of energy in the wire as the distance from the surface increases. In particular, signal transmission requirements have become higher because of the greater fidelity and sensitivity of currently available audio system equipment. This is especially true in audio speaker equipment.

However, the signal cables now utilized to convey alphanumeric pulse or audio frequency provide alternating current signals involving transmission principles that are much more complex than that of direct current transmission. In addition to the resistance encountered by electricity flowing through cables and connectors and the generation of magnetic fields, there is skin effect occurring between high and low frequencies as well as phase distortion. Skin effect is a phenomenon that causes electricity to be concentrated at the surface of a conductor with decreasing concentration of energy in the conductor as the distance from the surface increases. The concentration is for the most part uniform. However, when multiple electrical strands or wires are positioned near each other, strand interaction can cause a shift in where the center is located to a point closer to the other strands thereby decreasing the amount of power the cable can handle. It is known that a group of wires or strands behaves similarly to a single wire in that it has a higher concentration of energy near the surface and a lower concentration towards the center with each wire transferring a higher concentration of its energy near its surface and less towards its center.

In order to transmit a signal via an audio cable and connector at a balanced and totally true fidelity, at acoustic frequency ranges of 20 Hz to 20 kHz or wider, one must painstakingly design and match up an audio cable with a connector. By so doing, one can be assured that an amplified signal sounds similar to the original recording.

The design of a connector and its ability to interface with the multiple electrical wires or strands in an audio speaker cable is very important to obtaining transmission of high quality audio sounds.

Now an improved connector has been invented which has a unique securement configuration to allow a plurality of wires in an audio cable to be secured in a fashion that increases sound quality, minimizes distortion and eliminates skin effect. A combination connector and audio cable has also been invented, as well as a method of securing the connector to the audio cable.

SUMMARY OF THE INVENTION

Briefly, this invention relates to a connector for an audio cable which contains a plurality of wires each having an exposed terminal surface. The invention also relates to a combination connector and cable and a method of securing the connector to the cable. The connector includes a connector body formed from an electrically conductive material and having a longitudinal central axis. The connector body has a first end sized to abut an end of an audio cable, a second end shaped to be securely attached to a connecting post formed on a piece of audio equipment, and an exterior surface which extends between the first and second ends. The exterior surface has a first portion, a second portion and a third portion. The first portion has a circular outer periphery with a length measured parallel to the longitudinal central axis. The first portion is located adjacent to the first end and is sized to receive the exposed terminal surface of each of the plurality of wires present in the cable. The second portion is relatively flat and is located adjacent to the second end. The third portion converges downward from the first portion to the second portion. An insulating layer extends over the length of the first portion and surrounds the exposed terminal surface of each of the wires. A band surrounds the insulating layer and extends over the first portion. The band is formed from a pliable material which is capable of being reduced in circumference, such as by being squeezed or crimped, to provide a positive electrical interface between the exposed terminal surface of each of the wires and the outer periphery of the first portion.

The combination connector and audio cable includes a connector having a connector body formed from an electrically conductive material and having a longitudinal central axis. The connector body has a first end sized to abut an end of an audio cable, a second end shaped to be securely attached to a connecting post formed on a piece of audio equipment, and an exterior surface which extends between the first and second ends. The exterior surface has a first portion, a second portion and a third portion. The first portion has a circular outer periphery with a length measured parallel to the longitudinal central axis. The first portion is located adjacent to the first end and is sized to receive the exposed terminal surface of each of the plurality of wires present in the cable. The second portion is relatively flat and is located adjacent to the second end. The third portion converges downward from the first portion to the second portion. The audio cable has a flexible, hollow tubular core formed from a non-electrically conductive material. The tubular core has a longitudinal central axis, a first end, and a circumferential surface spaced at a constant radius from the longitudinal central axis. A plurality of spaced apart metallic wires extends along and are positioned outward of the circumferential surface. Each of the wires has an exposed terminal surface which extends beyond the first end of the tubular core. Each of the wires is positioned at an equal distance from the longitudinal central axis. Each of the exposed terminal surfaces of each wire is positioned on the outer periphery of the first portion to ensure a good connection. A cover layer surrounds the tubular core and the plurality of wires, and when the connector is abutted against the first end of the cable, each of the terminal ends of the wires will be secured to the outer periphery of the first portion. An insulating layer extends over the first portion and surrounds the exposed terminal surface of each of the wires. A band surrounds the insulating layer and extends over the first portion.

The band is formed from a pliable material which is capable of being reduced in circumference, such as being squeezed or crimped, to provide a positive electrical interface between the exposed terminal surfaces of the wires and the outer periphery of the first portion.

The method of securing a connector to an audio cable includes the steps of forming a connector having a connector body formed from an electrically conductive material and having a longitudinal central axis. The connector body has a first end sized to abut an end of an audio cable, a second end shaped to be securely attached to a connecting post formed on a piece of audio equipment, and an exterior surface which extends between the first and second ends. The exterior surface has a first portion, a second portion and a third portion. The first portion has a circular outer periphery with a length measured parallel to the longitudinal central axis. The first portion is located adjacent to the first end and is sized to receive an exposed terminal surface of one of the wires of the audio cable. The second portion is relatively flat and is located adjacent to the second end. The third portion converges downward from the first portion to the second portion. The method also includes forming an audio speaker cable having a flexible, hollow tubular core formed from a non-electrically conductive material. The tubular core has a longitudinal central axis, a first end, and a circumferential surface spaced at a constant radius from the longitudinal central axis. A plurality of spaced apart metallic wires extends spirally or longitudinally along the tubular core and are positioned outward of the circumferential surface. Each of the wires has an exposed terminal surface which extends beyond the first end of the tubular core and is positioned on the first portion. Each of the wires is positioned at an equal distance from the longitudinal central axis. A cover layer surrounds at least a portion of the tubular core and the plurality of wires. The method further includes abutting the first end of the connector against the first end of the cable such that each of the terminal ends of the wires will be secured to the outer periphery of the first portion. An insulating layer is then positioned over the first portion such that it surrounds the exposed terminal surfaces of each of the wires. A band is then positioned about the insulating layer such that it surrounds the first portion. The band is reduced in circumference, such as being squeezed or crimped, to provide a positive electrical interface between the exposed terminal surfaces of each of said wires and the outer periphery of the first portion.

The general object of this invention is to provide a connector for an audio cable. A more specific object of this invention is to provide a combination connector and audio speaker cable, and a method of securing the connector to the audio speaker cable.

Another object of this invention is to provide a connector which can be secured to an audio cable to provide increased sound quality.

A further object of this invention is to provide a connector which can be secured to an audio cable to minimize distortion therebetween.

Still another object of this invention is to provide a connector which can be secured to an audio cable to eliminate skin effect which equates to high frequency roll off or the difference in power at the lowest versus highest frequency during use.

Still further, an object of this invention is to provide a reasonably priced connector that can improve the audio quality being transmitted through an audio cable.

Other objects and advantages of the present invention will become more apparent to those skilled in the art in view of the following description and the accompanying drawings.

BRIEF DESCRIPTION OF THE DRAWINGS

FIG. 12 is a flow diagram depicting a method of securing a connector to an audio cable.

DETAILED DESCRIPTION OF THE INVENTION

Figure 1:
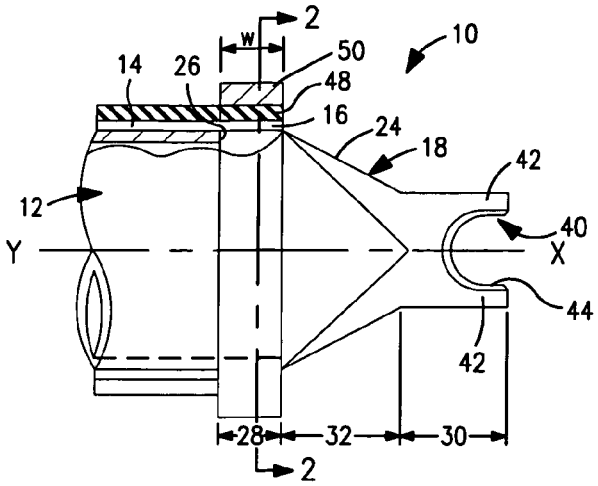
FIG. 1 is a partial cut away top view of the connector secured to an audio cable.
Figure 2:
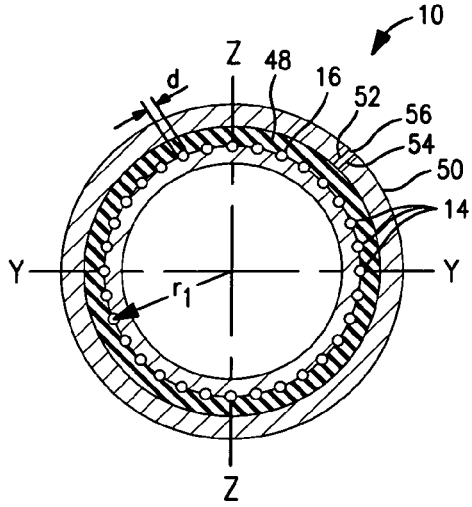
FIG. 2 is a cross-sectional view of the combination connector and a cable shown in FIG. 1 taken along line 2-2.

Referring to FIGS. 1-2, a connector 10 is shown for securing an audio cable 12 to a piece of audio equipment (not shown). The audio cable 12 can be an audio speaker cable or any other kind of audio cable. The audio cable 12 contains a plurality of wires 14 each having an exposed terminal surface 16. The actual number of wires 14 can vary. Typically, the number of wires 14 can ranges from between about 2 to about 200. Desirably, the number of wires 14 is four or more. More desirably, the number of wires 14 is twelve or more. Still more desirably, the number of wires 14 is twenty or more. Even more desirably, the number of wires is thirty-two or greater. Most desirably, the number of wires 14 will range from between about 12 to about 64.

Referring to FIGS. 1 and 3-6, the connector 10 has a connector body 18 which is formed from an electrically conductive material. Many different kinds of materials are electrically conductive. Silver, copper, brass and zinc are four materials that exhibit very good electrical conductivity. Silver is a lustrous ductile malleable metallic element having the highest thermal and electrical conductivity of the metals. Silver is used in soldering alloys, electrical contacts and in printed circuits. Silver has atomic number 47; atomic weight 107.868; melting point 960.8° C.; boiling point 2,212° C. and specific gravity of 10.50. Copper is a ductile malleable metallic element that is an excellent conductor of heat and electricity and is used in electrical wiring. Copper has atomic number 29; atomic weight 63.546; melting point 1,083° C.; boiling point 2,595° C. and specific gravity of 8.96. Brass is a yellowish alloy of copper and zinc. Zinc is a lustrous metallic element that is brittle at room temperature but malleable with heating. Zinc is used to form a wide variety of alloys including brass, bronze and nickel silver and is used to make electric fuses. Zinc has atomic number 30; atomic weight 65.37; melting point 419.4° C.; boiling point 907° C. and specific gravity of 7.133.

Other electrically conductive materials that are known to those skilled in the art can also be used. It is also possible to coat or plate a non-electrically conductive material to make it electrically conductive or to coat or plate an electrically conductive material to make it more electrically conductive. For example, the connector body 18 can be formed from an electrically conductive material, such as copper, and then can be coated or plated with silver and/or rhodium to make it even more electrically conductive. Alternatively, the connector body can be coated with a first electrically conductive material, such as silver, and then be coated with a second electrically conductive material, such as rhodium. In some applications, using two coats of different electrically conductive materials can enhance electrical conductivity.

The connector body 18 has a longitudinal central axis X-X, a transverse central axis Y-Y, and a vertical central axis Z-Z. The connector body 18 has a first end 20, a spaced apart second end 22, and an exterior surface 24 which extends between the first and second ends, 20 and 22 respectively. The first end 20 of the connector body 18 is sized to abut a first end 26 of the audio cable 12, see FIG. 1. The second end 22 of the connector body 18 is shaped to be securely attached to a connecting post (not shown) formed on a piece of audio equipment. The connecting post is generally cylindrical in shape and usually contains external threads spirally formed about its circumference. The first end 20 is much larger in size than the second end 22. Desirably, the first end 20 has a circular configuration while the second end 22 is relatively thin and flat.

Figure 3:
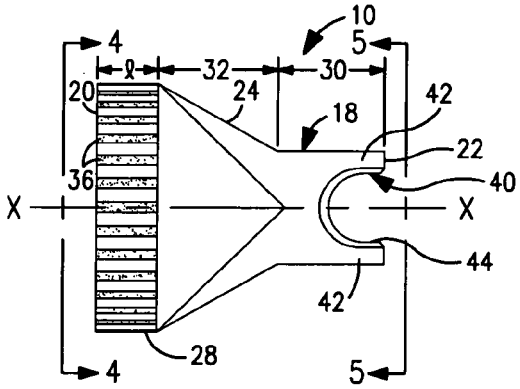
FIG. 3 is a top view of a connector for securing an audio cable to a piece of audio equipment.

Referring now to FIGS. 1, 3, 4 and 6, the exterior surface 24 of the connector body 18 has a first portion 28, a second portion 30 and a third portion 32. The first portion 28 has a circular outer periphery 34 and a length l measured parallel to the longitudinal central axis X-X. The first portion 28 is located adjacent to the first end 20 and can be smooth or have a plurality of cavities 36 formed therein. A plurality of cavities 36 are depicted in FIGS. 1 and 3. The cavities 36 can be equally spaced from one another or be irregularly spaced about the outer periphery 34. Desirably, each of the cavities 36 is equally spaced from an adjacent cavity 36. Each of the cavities 36 can have a wide variety of predetermined shapes and sizes.

In FIGS. 1, 3, 4 and 6, each of the cavities 36 has a dimension measured at the exterior surface of the first portion 28 and each of the wires 14 has a diameter approximately equal to the dimension of each of the cavities 36. Desirably, each of the cavities 36 has a semi-circular configuration when viewed from the first end 20, see FIG. 4. The configuration of each of the cavities 36 should approximately conform to half of the circular cross-sectional shape of each of the wires 14. For example, when each of the wires 14 has a circular cross-section shape, than each of the cavities 36 should have a semi-circular configuration. If the wires 14 have a square or rectangular cross-sectional shape, then the configuration of each of the cavities 36 can be altered or constructed to match half of the cross-sectional shape of each of the wires 14.

Figure 4:
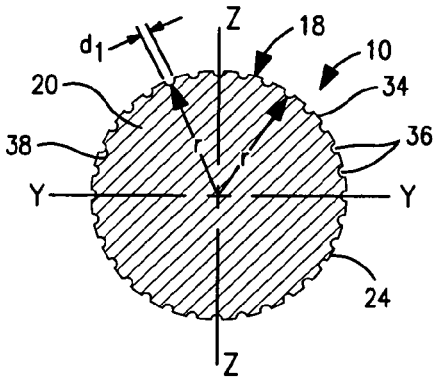
FIG. 4 is an end view of the connector shown in FIG. 3 taken along line 4-4.

Referring to FIGS. 2 and 4, the size of each of the cavities 36 should approximately equal half of the cross-sectional area of each of the wires 14. For example, if each of the wires 14 has a circular shape with a diameter d, see FIG. 2, then each of the cavities 36 should be semi-circular in shape with a diameter $d_1$, where d is approximately equal to $d_1$, see FIG. 4.

The configuration of one cavity 36 can be identical or different from the configuration of one of the other cavities 36. Desirably, all of the cavities 36 have the same configuration. The number of cavities 36 formed about the outer periphery 34 of the first portion 28 can vary. The number of cavities 36 can range from between 1 to about 200. Desirably, there are at least four cavities 36 formed in the outer periphery 34 of the first portion 28. More desirably, there are at least twelve cavities 36 formed in the outer periphery 34 of the first portion 28. Even more desirably, there are at least twenty cavities 36 formed in the outer periphery 34 of the first portion 28. Still more desirably, there are at least thirty-six cavities 36 formed in the outer periphery 34 of the first portion 28. The exact number of cavities 36 formed in the first portion 28 will depend upon the diameter of the first portion 28, the number of wires 14 that are present in the cable 12 that is to be secured to the connector 10, and the gauge of each of the wires 14.

Figure 5:
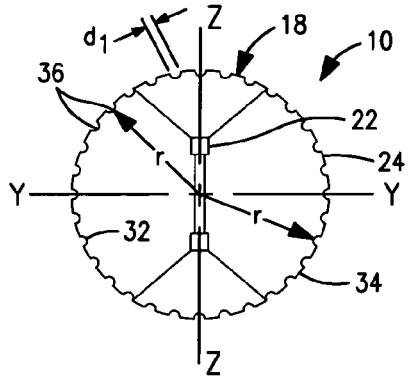
FIG. 5 is an end view of the connector shown in FIG. 3 taken along line 5-5.

Referring to FIGS. 4 and 5, one can clearly see that a bottom surface 38 of each of the cavities 36 is located at a radius r from the longitudinal central axis X-X. The bottom surface 38 of each of the cavities 36 should have the same radius r. This is important for it allows each of the wires 14, when positioned in one of the cavities 36, to be located at a radius $r_1$ from the longitudinal central axis X-X, see FIG. 2. The radius r is less than the radius $r_1$ since the radius $r_1$ is measured to the center of each of the wires 14. By positioning each of the wires 14 an equal distance from the longitudinal central axis X-X of the connector body 18, one can increase sound quality, minimize distortion in the audio cable 12, and minimizes phase distortion. By positioning each of the wires 14 an equal distance from the longitudinal central axis X-X, one can also eliminate skin effect which occurs between high and low frequencies. The phenomenon of "skin effect" causes electricity to be concentrated at the surface of a wire with decreasing concentration of energy in the wire as the distance from the surface increases. When one uses an audio cable 12 with multiple wires 14 which are equally spaced from the longitudinal central axis of both the cable 12 and the connector 10, one can transmit a signal with greater fidelity and clarity.

Referring back to FIG. 2, one can clearly see that each of the wires 14 has a diameter d. The diameter d can vary. Desirably, each of the wires 14 has the same diameter d. The diameter d of each wire 14 should be constant throughout its entire length. It should also be recognized that the size of an electrically conductive wire is commonly referred to by gauge. The "gauge" of a wire corresponds to a standard dimension which is well known to those skilled in making, selling and using electrical wires. If multiple wires each have the same gauge, then they will typically have the same diameter, provided each wire has a circular configuration.

Referring again to FIGS. 4 and 5, each of the semi-circular cavities 36 is shown having a diameter $d_1$ which should be approximately equal to the diameter d of each of the wires 14. If desired, the diameter $d_1$ could be sized to be slightly smaller or slightly larger than the diameter d of each of the wires 14. By sizing the diameter d of each of the wires 14 to match up with the diameter $d_1$ of each of the cavities 36, one can maintain each of the wires 14 at an equal radius $r_1$ from the longitudinal central axis X-X. Furthermore, when the diameter d of each of the wires 14 is approximately equal to the diameter $d_1$ of each of the cavities 36, one can be certain that a good electrical connection can be obtained between each of the wires 14 and the corresponding cavity 36.

Returning to FIGS. 1, 3 and 6, the first portion 28 of the exterior surface 24 has a length l which can vary in dimension. Desirably, the length l of the first portion 28 ranges from between about 5 millimeters (mm) to about 50 mm. More desirably, the length l of the first portion 28 ranges from between about 10 mm to about 40 mm. Even more desirably, the length l of the first portion 28 ranges from between about 10 mm to about 30 mm. Most desirably, the length l of the first portion 28 ranges from between about 10 mm to about 20 mm. The length of each of the cavities 36 can extend over a portion of or over the entire length l of the first portion 28. Desirably, the length of each cavity 36 will extend over at least 50% of the length l of the first portion 28. More desirably, the length of each cavity 36 will extend over at least 75% of the length l of the first portion 28. Even more desirably, the length of each cavity 36 will extend over at least 80% of the length l of the first portion 28. Most desirably, the length of each cavity 36 will extend over the entire length l of the first portion 28.

It should be understood that each of the wires 14 can be totally void of any insulation or covering along their entire length. Optionally, each of the wires 14 can be partially or totally surrounded or covered by insulation. If totally surrounded by a cover or by insulation, a small portion of the cover or insulation will need to be stripped off to expose the terminal surface 16. By "exposed terminal surface" it is meant that the wire 14 has a surface which is free from any covering or insulation which would normally surround the electrically conductive material from which the wire 14 is constructed. Desirably, the length dimension of the exposed terminal surface 16 of each wire 14 is approximately equal to the length l of the first portion 28. Alternatively, the length dimension of the exposed terminal surface 16 of each wire 14 can be less than or be greater than the length l of the first portion 28. The exposed terminal surface 16 circumferentially surrounds at least a portion of the circumference of each of the wires 14, as well as the axial end of each of the wires 14. Desirably, the exposed terminal surface 16 circumferentially surrounds at least 180 degrees of each of the wires 14. More desirably, the exposed terminal surface 16 circumferentially surrounds at least 270 degrees of each of the wires 14. Even more desirably, the exposed terminal surface 16 circumferentially surrounds 360 degrees of each of the wires 14. Each of the cavities 36 is sized to receive the exposed terminal surface 16 of one of the wires 14. The exposed terminal surface 16 should be snugly fitted into one of the cavities 36 in order to obtain a secure connection. Alternatively, the exposed terminal surface 16 can be interference fitted into one of the cavities 36. Another option is to solder each of the wires 14 at the exposed terminal surface 16 to the first portion 28. Still another option is to space the wires 14 around the first portion 28, which is void of the cavities 36, and solder, insulate and crimp the wires 14 in place to secure them to the connector body 18.

When each of the wires 14 is positioned in a respective cavity 36, the outer periphery of each of the exposed terminal surfaces 16 will contact at least 25% of the outer periphery of the first portion 28. Desirably, when each of the wires 14 is positioned in a respective cavity 36, the outer periphery of each of the exposed terminal surfaces 16 will contact at least 35% of the outer periphery of the first portion 28. More desirably, when each of the wires 14 is positioned in a respective cavity 36, the outer periphery of each of the exposed terminal surfaces 16 will contact at least 45% of the outer periphery of the first portion 28. Even more desirably, when each of the wires 14 is positioned in a respective cavity 36, the outer periphery of each of the exposed terminal surfaces 16 will contact approximately 50% of the outer periphery of the first portion 28.

Figure 6:
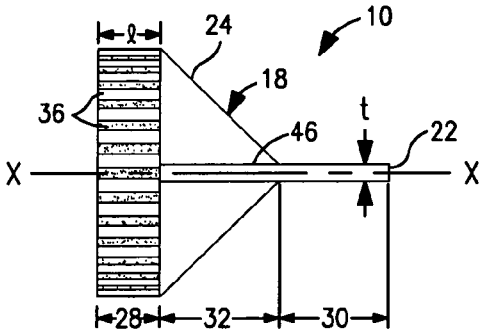
FIG. 6 is a side view of the connector shown in FIG. 3.

Referring now to FIGS. 1, 3 and 6, the connector body 18 has a second portion 30 which is relatively flat and is located adjacent to the second end 22. The second portion 30 can be aligned with the longitudinal central axis X-X of the connector body 18 or be offset therefrom. If the second portion is offset relative to the remainder of the connector body 18, it can be oriented at any desired angle. An angle ranging from between about 1 degree to about 30 degrees works best for many applications. Desirably, an angle of from between about 5 degrees to about 15 degrees is useful for connecting to some audio speaker equipment. More desirably, an angle of less than about 10 degrees is useful for connecting to some audio speaker equipment.

Referring again to FIGS. 1 and 2, the second portion 30 has a cutout 40 formed therethrough. The cutout 40 can be of various shapes including but not limited to: a C-shape, a U-shape, an elongated U-shape, a spade configuration, a circular aperture formed in the second portion 30, etc. As shown in FIG. 1, the cutout 40 has a pair of outwardly extending members 42, 42. It should be noted that if a circular aperture is formed in the second end 30, that no extending members 42, 42 would be present. The cutout 40 also has an interior surface 44. The interior surface 44 can be smooth, irregular or serrated. The interior surface 44 of the cutout 40 is sized to fit around the circumferential surface of an electrical post formed on a piece of audio equipment. The size of the cutout 40 can be varied to match up with posts of different diameters. For example, an electrical post can have a diameter of 0.25 inches, 0.375 inches, 0.5 inches, etc. The electrical post can be threaded such that a nut can be threaded onto the post to hold the second portion 30 secured to it.

It should be understood that the second portion 30 is not itself threaded onto the post but merely slides down adjacent to the outer circumference of the post. In this regard, the cutout 40 should be slightly larger than the diameter of the electrical post.

Referring now to FIG. 6, the second portion 30 has a thickness t. The thickness t can vary. Typically the thickness t of the second portion 30 is less than about 0.2 inches. Desirably, the thickness t of the second portion 30 is less than about 0.1 inches. More desirably, the thickness t of the second portion 30 is less than about 0.15 inches. Even more desirably, the thickness t of the second portion 30 is less than about 0.1 inches. It is not necessary to make the second portion 30 very thick since it is usually secured to the post by a nut, such as a hex nut or a wing nut, which ensures a positive attachment to the piece of audio equipment.

Referring again to FIGS. 1, 3 and 6, the connector body 18 also has a third portion 32 located between the first and second portions, 28 and 30 respectively. The third portion 32 converges downward from the first portion 28 to the second portion 30. The third portion 32 can taper downward, be stepped downward, or be angle downward using one or more linear surfaces, non-linear surfaces, arcuate surfaces, or a combination thereof. Optionally, a reinforcement rib 46 can span across the third portion 32 to provide extra stability. In FIG. 6, the reinforcement rib 46 is integrally formed with the second portion 30. Likewise, the reinforcement rib 46 can extend into the first portion 28 and/or into the second portion 30, if they are not solid members.

Referring again to FIGS. 1 and 2, the connector 10 also includes an insulating layer 48 which extends over at least the length l of the first portion 28. The insulating layer 48 surrounds the exposed terminal surface 16 of each of the wires 14 and can optional extend over the entire length of each of the wires 14. For a wire 14 having its own covering or insulation, the insulating layer 48 need only cover the exposed terminal surface 16. It should be noted that in FIG. 1, the insulating layer 48 extends over the entire length of each of the wires 14.

The insulating layer 48 can be constructed from various materials known to those skilled in the art for providing electrical insulation around an electrical wire. Rubber, plastic, polyolefins, and a number of non-conductive synthetic materials are commonly utilized to provide insulation to an electrical wire. The thickness of the insulating layer 48 can vary depending upon the material used to construct the insulating layer 48 and the amount of current being transferred through the electrical wire.

Referring to FIGS. 1 and 2, the connector 10 further includes a circular band 50 which is positioned about and surrounds the insulating layer 48. The band 50 can have a width w which is measured parallel to the longitudinal central axis X-X. The width w of the band 50 can be less than, equal to or be greater than the length l of the first portion 28. Desirably, the width w of the band 50 is approximately equal to the length l of the first portion 28. The band 50 circumferentially surrounds the first portion 28 of the connector body 18 and is positioned outward of the insulating layer 48. In FIG. 1, the band 50 is depicted as spanning the length l of the first portion 28. The band 50 is formed from a pliable and/or flexible material which is capable of being reduced in circumference, such as being squeezed or crimped, to provide a positive electrical interface between the exposed terminal surfaces 16 of each of the wires 14 and the outer periphery 34 of the first portion 28. The band 50 can be formed from an electrically conductive material or from a non-electrically conductive material since it is insulated from the wires 14 by insulating layer 48.

In FIG. 2, the band 50 is shown as being non-continuous and having a first end 52 and a second end 54. The spaced apart first and second ends, 52 and 54 respectively, are initially separated by a gap 56. As the band 50 is reduced in circumference, such as being squeezed or crimped, about the insulating layer 48 and the outer periphery 34 of the first portion 28, the separation between the first and second ends 52 and 54 respectively, is decreased such that the gap 56 becomes smaller. Alternatively, the band 50 can be reduced in circumference, such as being squeezed or crimped, such that the gap 56 disappears and the first and second ends, 52 and 54 respectively, either abut one another or overlap one another. Alternatively, the band 50 can be a continuous 360 degree circular band that is pliable and can be reduced in diameter by being squeezed upon itself such that it deformed.

Figure 7:
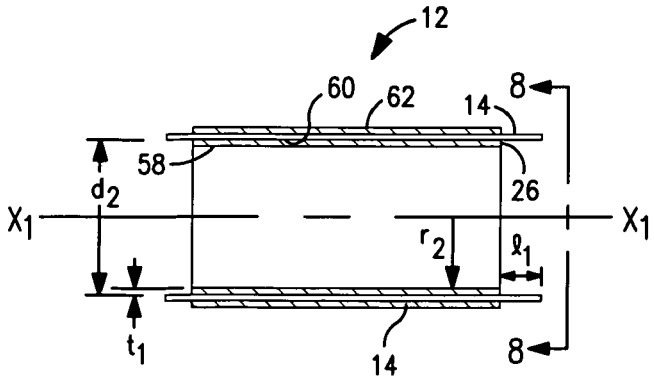
FIG. 7 is a cross-sectional view of an audio cable wherein the wires spiral along the length of the cable.
Figure 8:
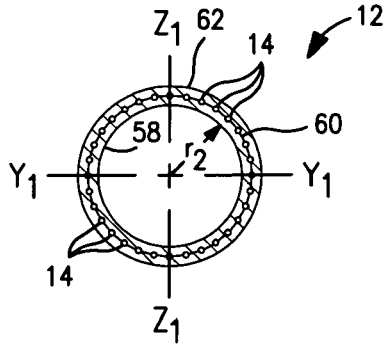
FIG. 8 is an end view of the audio cable shown in FIG. 7 taken along line 8-8.

Referring now to FIGS. 7 and 8, the audio cable 12 is shown being constructed from an elongated, hollow tubular core 58. The tubular core 58 has a longitudinal central axis $X_1$-$X_1$, a transverse central axis $Y_1$-$Y_1$, and a vertical central axis $Z_1$-$Z_1$. Desirably, the tubular core 58 is flexible and is capable of bending about the longitudinal central axis $X_1$-$X_1$. The tubular core 58 can be formed from various non-electrically conductive materials. For example, the tubular core 58 can be formed from Teflon, plastic, thermoplastic, a polyolefin such as polyethylene or polypropylene, polyester, fiberglass, a combination of two or more different materials, or from a variety of other materials known to those skilled in the art. Teflon works for a good tubular core 58 since it is relatively inexpensive, can be easily formed, and is light weight. The tubular core 58 has a first end 26 and a circumferential surface 60 which is spaced at a constant radius $r_2$ from the longitudinal central axis $X_1$-$X_1$. The tubular core 58 also has a diameter $d_2$ which can vary in dimension. The diameter $d_2$ of the tubular core 58 can range from about 0.01 inches to about 1 inch. Desirably, the diameter $d_2$ of the tubular core 58 will range from about 0.05 inches to about 0.5 inches. More desirably, the diameter $d_2$ of the tubular core 58 will range from about 0.1 inches to about 0.3 inches. Even more desirably, the diameter $d_2$ of the tubular core 58 will range from about 0.15 inches to about 0.25 inches.

The diameter $d_2$ of the tubular core 58 can be less than, equal to or be greater than the diameter of the first portion 28. Desirably, the diameter $d_2$ of the tubular core 58 is approximately equal to the outside diameter of the first portion 28. More desirably, the diameter $d_2$ of the tubular core 58 is identical to the outside diameter of the first portion 28.

Still referring to FIGS. 7 and 8, the tubular core 58 has a thin wall thickness $t_1$. The wall thickness $t_1$ can vary but usually is less than about 0.1 inches. Desirably, the wall thickness $t_1$ is less than 0.05 inches. More desirably, wall thickness $t_1$ is less than 0.03 inches. The tubular core 58 has a plurality of metallic electrically conductive wires 14 extending along and positioned outward of the circumferential surface 60. The wires 14 can extend longitudinally or spirally along the length of the tubular core 58. In FIG. 8, thirty-two electrical wires 14 are depicted. It should be understood that a fewer or a greater number of wires 14 could be utilized, if desired. Desirably, each of the wires 14 is spaced apart from one another such that they do not touch one another. Alternatively, the wires 14 can be arranged to touch one another or even overlap one another. The wires 14 can extend parallel to the longitudinal central axis $X_1$-$X_1$ or be positioned at an angle, such as being spirally wound relative to the longitudinal central axis $X_1$-$X_1$. Desirably, the wires 14 are spirally wound around the circumference of the tubular core 58. The wires 14 can be spirally wound at an angle from between 1 degree to less than 90 degrees relative to the longitudinal central axis $X_1$-$X_1$. Desirably, the wires 14 can be spirally wound at an angle of less than about 45 degrees when measured relative to the longitudinal central axis $X_1$-$X_1$. More desirably, the wires 14 can be spirally wound at an angle of less than about 30 degrees when measured relative to the longitudinal central axis $X_1$-$X_1$.

Each of the wires 14 has the exposed terminal surface 16 which extends beyond the first end 26 of the tubular core 58. Each of the wires 14 is positioned at an equal distance from the longitudinal central axis $X_1$-$X_1$. A cover layer 62 surrounds at least a portion of the tubular core 58 and the plurality of wires 14. The cover layer 62 can be formed from various materials. Desirably, the cover layer 62 is formed from an electrically insulating material. The thickness of the cover layer 62 can vary. When the connector body 18 is abutted against the first end 26 of the cable 12, the exposed terminal surface 16 of each of the wires 14 will physically contact the outer periphery 34 of the first portion 28.

Referring again to FIG. 7, one will notice that each of the wires 14 extends beyond the first end 26 of the tubular core 58 by a length $l_1$. The length $l_1$ an be less than, equal to or be greater than the length l of the first portion 28. Desirably, the length $l_1$ of each wire 14 is approximately equal to the length l of the first portion 28.

In order to increase the electrical conductivity and/or corrosion-resistant between the first portion 28 and each of the wires 14, one can coat or plate the outer periphery 34 of the first portion 28 with various materials including but not limited to: silver, rhodium, platinum, nickel, iridium, osmium, etc. Silver is a lustrous ductile malleable metallic element having the highest thermal and electrical conductivity of the metals. Silver is used in soldering alloys, electrical contacts and in printed circuits. Silver has atomic number 47; atomic weight 107.868; melting point 960.8° C.; boiling point 2,212° C. and specific gravity of 10.50. Rhodium is a hard durable metallic element that is used to form high-temperature alloys with platinum and produce a corrosion-resistant coating on other metals. Rhodium has atomic number 45; atomic weight 102.905; melting point 1,996° C.; boiling point 3,727° C. and a specific gravity of 12.41. Platinum is a ductile malleable metallic element usually occurring mixed with other metals such as iridium, osmium, or nickel and is used in electrical components. Nickel is a silvery hard ductile ferromagnetic metallic element used in alloys and in corrosion-resistant surfaces and batteries and for electroplating. Nickel has atomic number 28; atomic weight 58.71; melting point 1,453° C.; boiling point 2,732° C. and specific gravity of 8.902. Iridium is a hard, brittle, corrosion-resistant metallic element occurring in platinum ores and used in electrical contacts. Iridium has atomic number 77; atomic weight 192.2; melting point 2,410° C.; boiling point 4,130° C. and specific gravity of 22.42. Osmium is a hard metallic element found in small amounts in osmiridium and platinum ores and used as a platinum hardener. Osmium has atomic number 76; atomic weight 190.2; melting point 3,000° C.; boiling point 5,000° C. and specific gravity of 22.57.

Referring back to FIG. 1 once again, the combination of the connector 10 and the cable 12 is depicted. It should be understood that a manufacturer can install the connector 10 onto the first end 26 of the cable before the combination is sold. Alternatively, the connector 10 and the cable 12 can be sold as separate articles or be sold together but be unconnected. In the later cases, the consumer would then secure the connector 10 onto the first end 26 of the cable 12.

Figure 10:
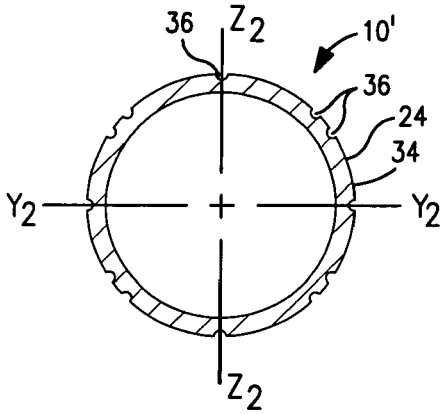
FIG. 10 is an end view of the connector shown in FIG. 9 taken along line 10-10.
Figure 9:
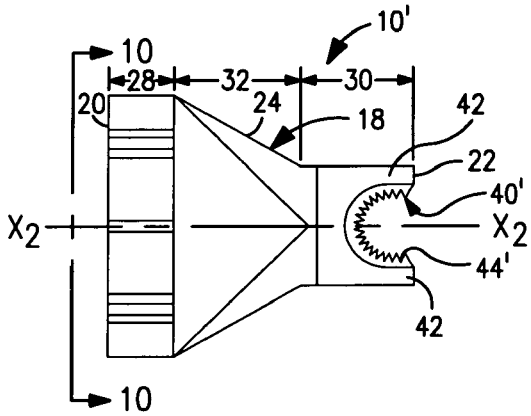
FIG. 9 is a top view of an alternative embodiment of a connector for securing an audio cable to a piece of audio equipment and showing irregularly placed cavities.

Referring now to FIGS. 9 and 10, an alternative embodiment of a connector 10' is depicted which can be secured to an audio cable 12 (not shown). The connector 10' is similar to the connector 10 except for a couple of features. First, the connector 10' has a longitudinal central axis $X_2$-$X_2$, a transverse central axis $Y_2$-$Y_2$, and a vertical central axis $Z_2$-$Z_2$. Second, as best seen in FIG. 10, the semi-circular cavities 36 are irregularly spaced about the outer periphery 34 of the first portion 28. Four of the cavities 36 are aligned with the points where the transverse central axis $Y_2$-$Y_2$ and a vertical central axis $Z_2$-$Z_2$ intersect the outer periphery 34 of the first portion 28. In addition, a pair of cavities 36, 36, spaced rather close together, is situated between each pair of cavities 36, 36 that intersect the adjacent transverse and vertical axes, $Y_2$-$Y_2$ and $Z_2$-$Z_2$ respectively. Third, the connector 10' has an elongated cutout 40' with a serrated interior surface 44'. The shape of the elongated cutout 40' and the serrated interior surface 44' can assist in securely attaching the connector 10' to an electrical post which is present on a piece of audio equipment.

Figure 11:
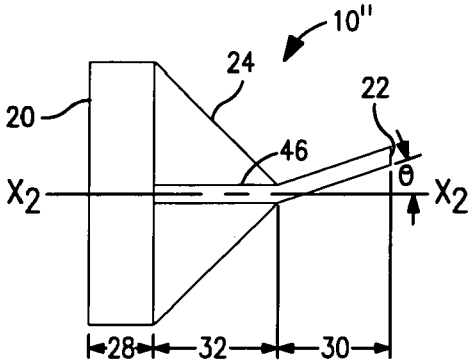
FIG. 11 is a side view of still another embodiment of a connector showing a first portion with no cavities formed therein and a second portion which is angled relative to the longitudinal central axis X-X.

Referring now to FIG. 11, still another embodiment of a connector 10" is depicted which can be secured to an audio cable 12 (not shown). The connector 10" is similar to the connector 10' except for two differences. First, the first portion 28 is smooth and does not have any cavities 36 formed therein. In this embodiment, the wires 14 can be soldered to the smooth surface of the first portion 28 to ensure a secure attachment. Second, the second portion 30 is oriented at an angle theta 8 to the longitudinal central axis $X_2$-$X_2$. The angle θ can range from between about 1 degree to about 45 degrees relative to the longitudinal central axis $X_2$-$X_2$. Desirably, the angle θ ranges from between about 2 degrees to about 30 degrees relative to the longitudinal central axis $X_2$-$X_2$. More desirably, the angle θ ranges from between about 3 degrees to about 15 degrees relative to the longitudinal central axis $X_2$-$X_2$. Even more desirably, the angle θ is at least 10 degrees as measured relative to the longitudinal central axis $X_2$-$X_2$. By angling the second portion 30, it may be easier to connect the connector 10" to an electrical post which is present on a piece of audio equipment.

Method

Referring to FIG. 12, a flow diagram is depicted of a method of securing a connector 10, or 10' to an audio cable 12. The method includes the steps of forming a connector body 18 from an electrically conductive material. The connector body 18 has a longitudinal central axis X-X, a transverse central axis Y-Y, and a vertical central axis Z-Z. The connector body 18 also has a first end 20 sized to abut a first end 26 of an audio cable 12, a second end 22 shaped to be securely attached to a connecting post formed on a piece of audio equipment, and an exterior surface 24 which extends between the first and second ends, 20 and 22 respectively. The exterior surface 24 has a first portion 28, a second portion 30 and a third portion 32. The first portion 28 has a circular outer periphery 34 with a length l measured parallel to the longitudinal central axis X-X. The first portion 28 is located adjacent to the first end 20 and can be smooth or have a plurality of cavities 36 formed therein. When the cavities 36 are present, desirably they have a semi-circular configuration. The cavities 36 can be equally spaced from one another or be non-equally spaced from one another. The number of cavities 36 can vary. Typically 2, 4, 8, 10, 12, 18, 20, 24, 32, 64 or more cavities 36 can be formed in the outer periphery 34 of the first portion 28. If no cavities 36 are present, the exposed terminal surface 16 of each of the wires 14 is secured to the smooth outer surface of the first portion 28 such as with solder. When the cavities 36 are present, each is sized to receive an exposed terminal surface 16 of each of the wires 14. For example, the diameter of each of the wires 14 can be approximately equal to the diameter of each of the cavities 36. The second portion 30 is relatively flat and is located adjacent to the second end 22. The third portion 32 converges downward from the first portion 28 to the second portion 30.

The method also includes forming an audio cable 12 having a flexible, hollow tubular core 58 formed from a non-electrically conductive material. The tubular core 58 has a longitudinal central axis $X_1$-$X_1$, a transverse central axis $Y_1$-$Y_1$, and a vertical central axis $Z_1$-$Z_1$. The tubular core 58 also has a first end 26 and a circumferential surface 60 spaced at a constant radius $r_2$ from the longitudinal central axis $X_1$-$X_1$. A plurality of spaced apart metallic wires 14 extend along and are positioned outward of the circumferential surface 60. Each of the wires 14 has an exposed terminal surface 16 which extends beyond the first end 16 of the tubular core 58. Each of the wires 14 can be formed from an electrically conductive material such as silver, copper, brass, rhodium, etc. Desirably, each of the wires 14 is spirally wound on the tubular core 58 such that a wire 14 will not touch an adjacent wire 14. In addition, each of the wires 14 can have a circular cross-section with a predetermined diameter $d_2$. Each of the wires 14 is positioned at an equal distance from the longitudinal central axis $X_1$-$X_1$. When the exposed terminal surface 16 of each of the wires 14 is inserted into one of the cavities 36, each wire 14 will be located at an equal distance from the longitudinal central axis X-X of the connector body 18. If no cavities 36 are present, each of the wires 14 will still be located at an equal distance from the longitudinal central axis X-X of the connector body 18. A cover layer 62 surrounds at least a portion of the tubular core 58 and the plurality of wires 14. The first end 20 of the connector body 18 is then abutted against the first end 26 of the cable 12 such that the exposed terminal surface 16 of each of the wires 14 will either contact the outer surface of the first portion 28 or be positioned in one of the cavities 36 formed in the first portion 28.

The method further includes positioning an insulating layer 48 over at least the length l of the first portion 28 such that it surrounds the exposed terminal surface 16 of each of the wires 14. A pliable band 50 is then positioned about the insulating layer 48 such that it extends over the first portion 28. The band 50 is then reduced in circumference, such as being squeezed or crimped, to provide a positive electrical interface between the exposed terminal surface 16 of each of the wires 14 and the first portion 28.

It should be understood that the outer periphery 34 of the first portion 28 can be coated or plated with rhodium or some other highly electrically conductive material to increase its electrical conductivity and make it resistant to corrosion.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A connector for an audio cable which contains a plurality of wires each having an exposed terminal surface, comprising:

a) a connector body formed from an electrically conductive material and having a longitudinal central axis, said connector body having a first end sized to abut an end of an audio cable, a second end shaped to be securely attached to a connecting post formed on a piece of audio equipment, and an exterior surface which extends between said first and second ends, said exterior surface having a first portion, a second portion and a third portion, said first portion having a circular outer periphery with a length measured parallel to said longitudinal central axis, said first portion being located adjacent to said first end, said first portion is sized to receive said exposed terminal surface of each of said wires, said second portion being relatively flat and located adjacent to said second end, and said third portion converges downward from said first portion to said second portion;

b) an insulating layer extending over at least the length of said first portion and surrounding said exposed terminal surface of each of said wires; and c) a band surrounding said insulating layer and extending over said first portion, said band being formed from a pliable material which is capable of being reduced in circumference to provide a positive electrical interface between said exposed terminal surface of each of said wires and said first portion.

2. The connector of claim 1 wherein said first portion has a plurality of cavities formed therein, each of said cavities has a dimension measured at said exterior surface of said first portion, and each of said wires has a diameter approximately equal to said dimension of each of said cavities, and each of said wires when positioned in one of said cavities is located at an equal distance from said longitudinal central axis.

3. The connector of claim 2 wherein each of said cavities has a semi-circular configuration and each of said cavities is spaced an equal distance from an adjacent semi-circular cavity.

4. The connector of claim 3 wherein each of said semi-circular cavities has a length that is at least 50% of said length of said first portion.

5. The connector of claim 4 wherein each of said semi-circular cavities has a length that is equal to said length of said first portion.

6. The connector of claim 5 wherein there are at least twelve semi-circular cavities equally spaced about said outer periphery of said first portion.

7. The connector of claim 5 wherein said outer periphery is plated with rhodium to increase electrical conductivity and make it resistant to corrosion.

8. The connector of claim 2 wherein said cavities are irregularly spaced about said outer periphery of said first portion.

9. The connector of claim 2 wherein there are at least thirty-two cavities equally spaced about said outer periphery of said first portion.

10. A combination connector and audio cable comprising:

a) a connector body formed from an electrically conductive material and having a longitudinal central axis, said connector body having a first end sized to abut an end of an audio cable, a second end shaped to be securely attached to a connecting post formed on a piece of audio equipment, and an exterior surface which extends between said first and second ends, said exterior surface having a first portion, a second portion and a third portion, said first portion having a circular outer periphery with a length measured parallel to said longitudinal central axis, said first portion being located adjacent to said first end and having a plurality of cavities formed therein, each of said cavities is sized to receive an exposed terminal surface of a wire, said second portion being relatively flat and located adjacent to said second end, and said third portion converges downward from said first portion to said second portion;

b) an audio cable having a flexible tubular core formed from a non-electrically conductive material, said core having a longitudinal central axis, a first end, and a circumferential surface spaced at a constant radius from said longitudinal central axis, a plurality of spaced apart metallic wires extending along and positioned outward of said circumferential surface, each of said wires having an exposed terminal surface which extends beyond said first end of said tubular core, each of said wires being positioned at an equal distance from said longitudinal central axis, and a cover layer surrounding at least a portion of said tubular core and said plurality of wires, and when said connector body is abutted against said first end of said cable said exposed terminal surface of each of said wires will contact said first portion;

c) an insulating layer extending over at least the length of said first portion and surrounding said exposed terminal surface of each of said wires; and d) a band surrounding said insulating layer and extending over said first portion, said band being formed from a pliable material which is capable of being reduced in circumference to provide a positive electrical interface between said exposed terminal surfaces of each of said wires and said first portion.

11. The combination of claim 10 wherein said tubular core is hollow having a wall thickness of less than about 0.1 inches, and said tubular core is formed from Teflon.

12. The combination of claim 10 wherein said tubular core and said first portion have an identical outside diameter, said length of said first portion ranges from between about 10 millimeters to about 20 millimeters, each of said cavities has a semi-circular configuration and each of said semi-circular cavities has a length equal to said length of said first portion.

13. The combination of claim 10 wherein each of said wires is formed from silver, copper or brass, and said outer periphery of said first portion is plated with rhodium to increase its electrical conductivity and make it resistant to corrosion.

14. The combination of claim 10 wherein each of said exposed terminal surfaces has an outer periphery and at least 45% of said outer periphery is in contact with said first portion.

15. The combination of claim 10 wherein said second end of said connector has a spade configuration with a U-shaped cutout which is angled at least 10 degrees relative to said longitudinal central axis of said connector body.

16. A method of securing a connector to an audio cable, comprising the steps of:

a) forming a connector body from an electrically conductive material, said connector body having a longitudinal central axis, a first end sized to abut an end of an audio cable, a second end shaped to be securely attached to a connecting post formed on a piece of audio equipment, and an exterior surface which extends between said first and second ends, said exterior surface having a first portion, a second portion and a third portion, said first portion having a circular outer periphery with a length measured parallel to said longitudinal central axis, said first portion being located adjacent to said first end and having a plurality of cavities formed therein each being sized to receive an exposed terminal surface of a wire, said second portion being relatively flat and located adjacent to said second end, and said third portion converges downward from said first portion to said second portion;

b) forming an audio cable having a flexible tubular core formed from a non-electrically conductive material, said core having a longitudinal central axis, a first end, and a circumferential surface spaced at a constant radius from said longitudinal central axis, a plurality of spaced apart metallic wires extending along and positioned outward of said circumferential surface, each of said wires having an exposed terminal surface which extends beyond said first end of said tubular core, each of said wires being positioned at an equal distance from said longitudinal central axis, and a cover layer surrounding at least a portion of said tubular core and said plurality of wires;

c) abutting said first end of said connector against said first end of said cable such that said exposed terminal surface of each of said wires will be positioned in one of said cavities;

d) positioning an insulating layer over at least the length of said first portion such that it surrounds said exposed terminal surface of each of said wires;

e) positioning a pliable band about said insulating layer such that it extends over said first portion; and f) reducing the circumference of said pliable band to provide a positive electrical interface between said exposed terminal surface of each of said wires and said first portion.

17. The method of claim 16 further comprising forming each of said cavities with a semi-circular configuration having a diameter approximately equal to a diameter of each of said wires, and each of said wires when positioned in one of said semi-circular cavities is located at an equal distance from said longitudinal central axis of said connector.

18. The method of claim 17 further comprising forming at least 20 semi-circular cavities in said outer periphery of said first portion and each of said semi-circular cavities being equally spaced from one another.

19. The method of claim 18 further comprising forming each of said wires from silver into a circular cross-section with a predetermined diameter and positioned said exposed terminal surface of each of said wires into one of said semi-circular cavities such that approximately 50% of said diameter of each wire is in direct contact with said first portion.

20. The method of claim 16 further comprising plating said outer periphery of said first portion with rhodium to increase its electrical conductivity and make it resistant to corrosion.

* * * * *

UNITED STATES PATENT AND TRADEMARK OFFICE

CERTIFICATE OF CORRECTION

PATENT NO. : 7,686,663 B1
APPLICATION NO. : 12/317841
DATED : March 30, 2010
INVENTOR(S) : Benjamin Zapolsky It is certified that error appears in the above-identified patent and that said Letters Patent is hereby corrected as shown below:

In Column 4, Line 39, remove the "s" after "ranges".
[i.e., it should read, "...wires 14 can range from..."]

In Column 8, Line 47, add remove "angle" and replace with "angled".
[i.e., it should read, "...or can be angled downward..."]

In Column 10, Line 46, remove "an" and replace with "can".
[i.e., it should read, "The length l1 can be less than..."]

In Column 11, Line 50, remove "8" and replace with "θ".
[i.e., it should read, "...angle theta θ to the longitudinal..."]

Signed and Sealed this

Twenty-fifth Day of May, 2010

David J. Kappos

David J. Kappos
*Director of the United States Patent and Trademark Office*